US009334707B1

(12) United States Patent
Adger, Jr.

(10) Patent No.: US 9,334,707 B1
(45) Date of Patent: May 10, 2016

(54) EMERGENCY WELL PLUG APPARATUS

(71) Applicant: Roy L. Adger, Jr., Los Angeles, CA (US)

(72) Inventor: Roy L. Adger, Jr., Los Angeles, CA (US)

( * ) Notice: Subject to any disclaimer, the term of this patent is extended or adjusted under 35 U.S.C. 154(b) by 577 days.

(21) Appl. No.: 13/847,339

(22) Filed: Mar. 19, 2013

(51) Int. Cl.
*E21B 33/127* (2006.01)
*E21B 47/01* (2012.01)
*F16L 55/134* (2006.01)

(52) U.S. Cl.
CPC ..... *E21B 33/127* (2013.01)

(58) Field of Classification Search
CPC ..... E21B 33/127; E21B 33/1277; E21B 33/1243; E21B 33/13; E21B 33/035; E21B 33/076; E21B 47/01; F16L 55/134; F16K 7/10

See application file for complete search history.

(56) References Cited

U.S. PATENT DOCUMENTS 1,549,168 A * 8/1925 Townsend ..... 277/331
2,227,730 A * 1/1941 Lynes ..... 166/147
2,231,282 A * 2/1941 Norris ..... 166/151
2,629,446 A * 2/1953 Freling et al. ..... 277/333
2,681,706 A * 6/1954 Pottorf ..... 277/333
3,052,302 A * 9/1962 Lagucki ..... 166/153
3,104,717 A * 9/1963 Adelbert et al. ..... 277/334
3,125,163 A * 3/1964 Smith ..... 166/187
3,491,922 A * 1/1970 Mylting ..... 222/442
3,665,966 A 5/1972 Ver Nooy
4,030,545 A * 6/1977 Nebolsine ..... 166/191
4,467,865 A * 8/1984 Hardymon ..... 166/102
4,500,095 A 2/1985 Schisler et al.
4,614,206 A * 9/1986 Mathison et al. ..... 138/93
4,616,987 A * 10/1986 Boyers et al. ..... 425/89
5,205,358 A 4/1993 Mitzlaff
5,392,853 A * 2/1995 Toon ..... 166/187
5,725,055 A * 3/1998 Schirmer et al. ..... 166/264
6,431,273 B1 * 8/2002 McGarian et al. ..... 166/183
9,010,435 B2 * 4/2015 Matsur ..... 166/351

* cited by examiner

*Primary Examiner* — Blake Michener
*Assistant Examiner* — Kipp Wallace
(74) *Attorney, Agent, or Firm* — Crossley & Stevenson IP Law

(57) ABSTRACT

An emergency well plug apparatus that includes a drill string mating unit connectable endwise to an extant drill string, a top ring releasably attachable to the drill string mating unit, at least one support member attachable to the top ring, and additional support members attachable thereto, wherein sequential inflation of respective inflatable members disposed upon each support member effectively plugs a blowout preventer, wellhead, or well shaft, from gushing fluids and the drill string mating unit may be subseqeuntly retracted with the remainder of the apparatus in place.

10 Claims, 7 Drawing Sheets

EMERGENCY WELL PLUG APPARATUS

BACKGROUND OF THE INVENTION

Various types of emergency well plug apparatus are known in the prior art. However, what is needed is an emergency well plug apparatus that includes a drill string mating unit connectable endwise to an extant drill string, a top ring releasably attachable to the drill string mating unit, at least one support member attachable to the top ring, and additional support members attachable thereto, wherein sequential inflation of respective inflatable members disposed upon each support member effectively plugs a blowout preventer, wellhead, or well shaft, from gushing fluids and the drill string mating unit may be subseqeuntly retracted with the remainder of the apparatus in place.

FIELD OF THE INVENTION

The present invention relates to an emergency well plug apparatus, and more particularly, to an emergency well plug apparatus that includes a drill string mating unit connectable endwise to an extant drill string, a top ring releasably attachable to the drill string mating unit, at least one support member attachable to the top ring, and additional support members attachable thereto, wherein sequential inflation of respective inflatable members disposed upon each support member effectively plugs a blowout preventer, wellhead, or well shaft, from gushing fluids and the drill string mating unit may be subseqeuntly retracted with the remainder of the apparatus in place.

SUMMARY OF THE INVENTION

The general purpose of the emergency well plug apparatus, described subsequently in greater detail, is to provide an emergency well plug apparatus which has many novel features that result in an emergency well plug apparatus which is not anticipated, rendered obvious, suggested, or even implied by prior art, either alone or in combination thereof.

With the increasing exploitation of off-shore deposits and deep-sea extraction of natural resources comes added risk of pollution and waste from ruptured wellheads. Drilling at such depths and pressures renders a wellhead far removed from the drill platform, a wellhead practically inaccessible should trouble arise and a blowout occur. As exploitation of domestic oil and natural gas fields continues to grow, at greater depths, in more varied substrates, and further off shore, more catastrophic blowouts are feasible with lasting impacts on the environment and local economies affected by the subsequent pollution.

What is needed is an emergency well plug apparatus removably insertable into a wellhead to stem the runaway ejection of fluids therefrom. The present emergency well plug apparatus has been devised to attach endwise to a drill collar or drill string in lieu of a drill bit, there lowerable into a blowout preventer, wellhead, or shaft, to plug said well by inflation of at least one inflatable member disposed upon an associated support member, said support member releasably attachable to a top ring releasably fastened to a drill string mating unit. Once in position with the at least one inflatable member inflated, the top ring and drill string mating unit may be decoupled, and the drill string retracted from the wellhead leaving the remainder of the apparatus in situ.

The present emergency well plug apparatus has been componentized to enable ready repair to individual pieces and afford adaptability to a particular wellhead, blowout, or situation wherein a particular ejection pressure must be countered to effectively plug the well and prevent further fluids from gushing therefrom.

The present emergency well plug apparatus includes the drill string mating unit, the top ring, and at least one support member releasably attachable to the top ring. The drill string mating unit is contemplated to be releasably fitted to a drill collar in lieu of a drill bit, or otherwise connected endwise to a suitable drill string. The drill string mating unit includes an annular surface and an annular undersurface disposed around a beveled intake configured downwardly from the annular undersurface. A first aperture is disposed centrally upon the beveled intake and a plurality of locking studs are disposed upon the annular undersurface, each of said plurality of locking studs moveable from a first position to a second position.

The top ring is configured to releasably connect to the drill string mating unit and includes a plurality of latch members disposed upwardly from a top surface thereon. Each of said latch members is configured to releasably engage with each of the plurality of locking studs when the drill string mating unit and top ring are coupled and the plurality of locking studs moved to the first position. The top ring includes a beveled fitting configured to superimpose over the beveled intake of the drill string mating unit. A second aperture disposed centrally in the beveled fitting is disposed to superimpose over the first aperture when the drill string mating unit and top ring are coupled.

An electronic data port is disposed upon the annular surface of the drill string mating unit. The electronic data port is contemplated to enable connection of the apparatus to a control panel disposed upon the relevant drill platform whereat an operator is enabled to operatively control the apparatus. The electronic data port includes connection means disposed to interconnect the electronic data port with circuitry disposed in the top ring and throughout the apparatus. In the preferred embodiment herein disclosed, the connection means is considered as at least one prong member disposed projecting from the annular undersurface, said prong member configured to insert into at least one slot member disposed upon a data port connector appropriately positioned upon the top surface of the top ring. Thus coupling of the drill string mating unit and the top ring interconnects the electronic data port and data port connector.

At least one support member is attachable to the top ring at the second aperture. Each of the at least one support member includes a central pipe member having an inset threaded first end and a second end. The inset threaded first end is releasably and securably insertable into the second aperture and a ring surface disposed around the inset threaded first end sealingly engages circumferentially around the second aperture.

A disk member is perpendicularly disposed upon the second end. The disk member has a diameter proximal to the outer diameter of the top ring. An inflatable member is disposed surrounding the central pipe member, upon the disk member. When caused to inflate, in the manner to be described subsequently, the inflatable member maintains an outer diameter greater than that of the disk member.

An air outlet is disposed in the surface of the pipe member proximal to the first end. An air conduit is disposed through each of the first and second apertures into the central pipe member to vent at the air outlet. Air may be forcibly vented through the air outlet to inflate the inflatable member, when desired, when the emergency well plug apparatus is positioned within a particular wellhead to stem eruption of fluids therefrom.

A subsequent support member is connectable to a threaded aperture disposed in the second end of a previously attached support member. As such, a plurality of support members is connectable longitudinally in a series to a length desirable to plug a specific well to a desired depth. Each of said support members is identical, and may be readily interchanged, as needed. Additional air conduits may be routed through each central pipe member to vent at a relevant air outlet to inflate an associated inflatable member.

In use, the emergency well plug apparatus is lowered into a particular blowout preventer, wellhead, or well shaft, as case may be. Once in position, the inflatable members are sequentially inflated, starting with the respective inflatable member disposed on the lowermost support member. Subsequent inflation of each inflatable member occurs in series, moving upwards towards the top ring. Each inflation episode is contemplated to reduce pressure at the subsequently inflated inflation member, whereby a well may be plugged by a series of inflation episodes. Moreover, the more inflation members used, and thus inflated and engaged against the casing or well shaft, the greater the apparatus's resistance to pressure from the well, and the more securely embedded the emergency well plug apparatus may be.

Once inflated, pressure sensors connected in circuit with the electronic data port signal to the operator stability of the device. Thence the drill string mating unit may be decoupled from the top ring when each of the plurality of locking studs is moved to the second position, and the drill string may be retracted from the well head.

Once normal well operations are to be resumed, the drill string with drill string mating unit attached may be lowered to the wellhead, re-coupled with the top ring, each inflation member deflated, and the apparatus withdrawn from the well head, as desired.

Thus has been broadly outlined the more important features of the present emergency well plug apparatus so that the detailed description thereof that follows may be better understood and in order that the present contribution to the art may be better appreciated.

Objects of the present emergency well plug apparatus, along with various novel features that characterize the invention are particularly pointed out in the claims forming a part of this disclosure. For better understanding of the emergency well plug apparatus, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
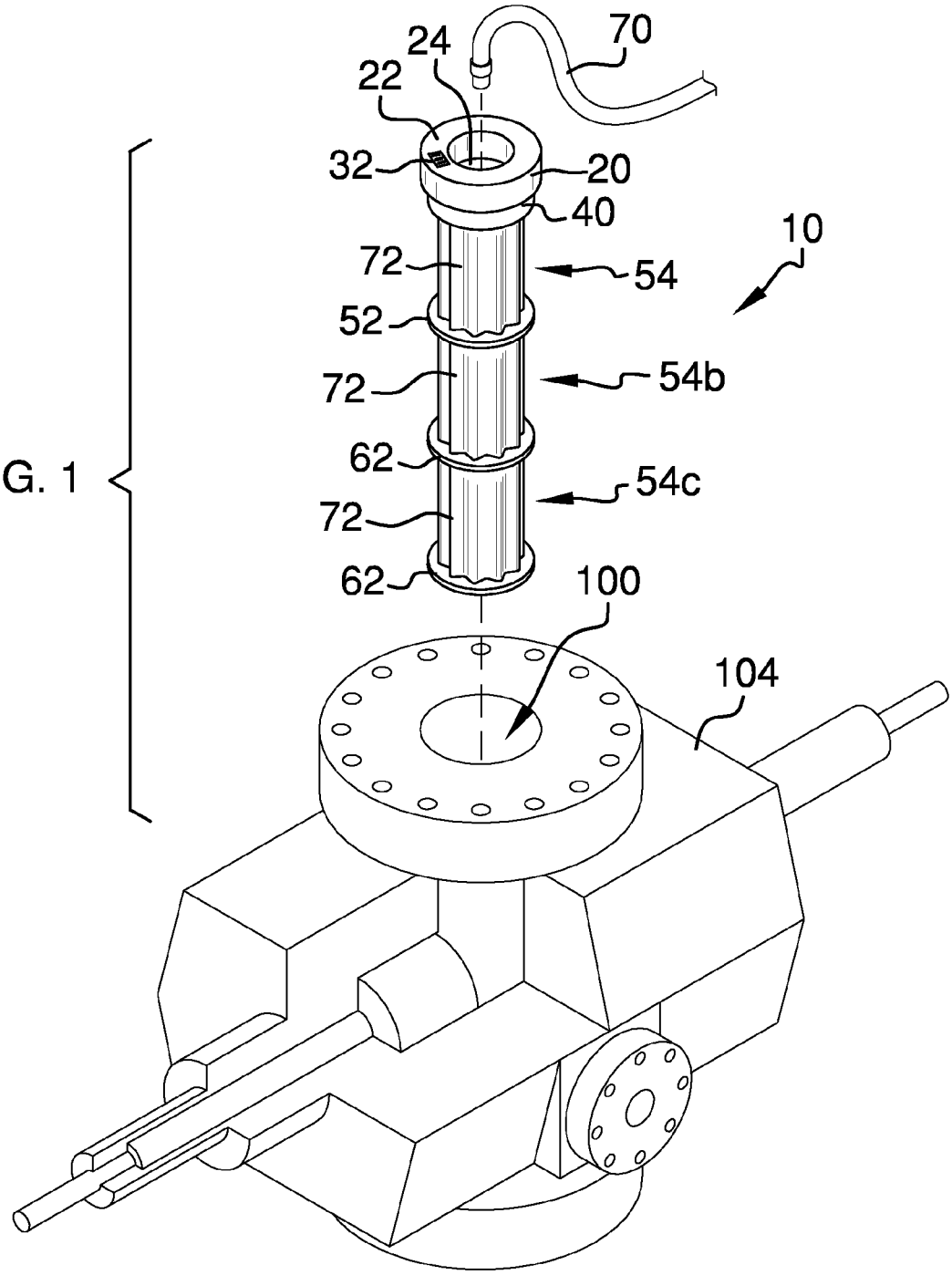
FIG. 1 is an isometric view of an emergency well plug apparatus and an extant blowout preventer.
Figure 2:
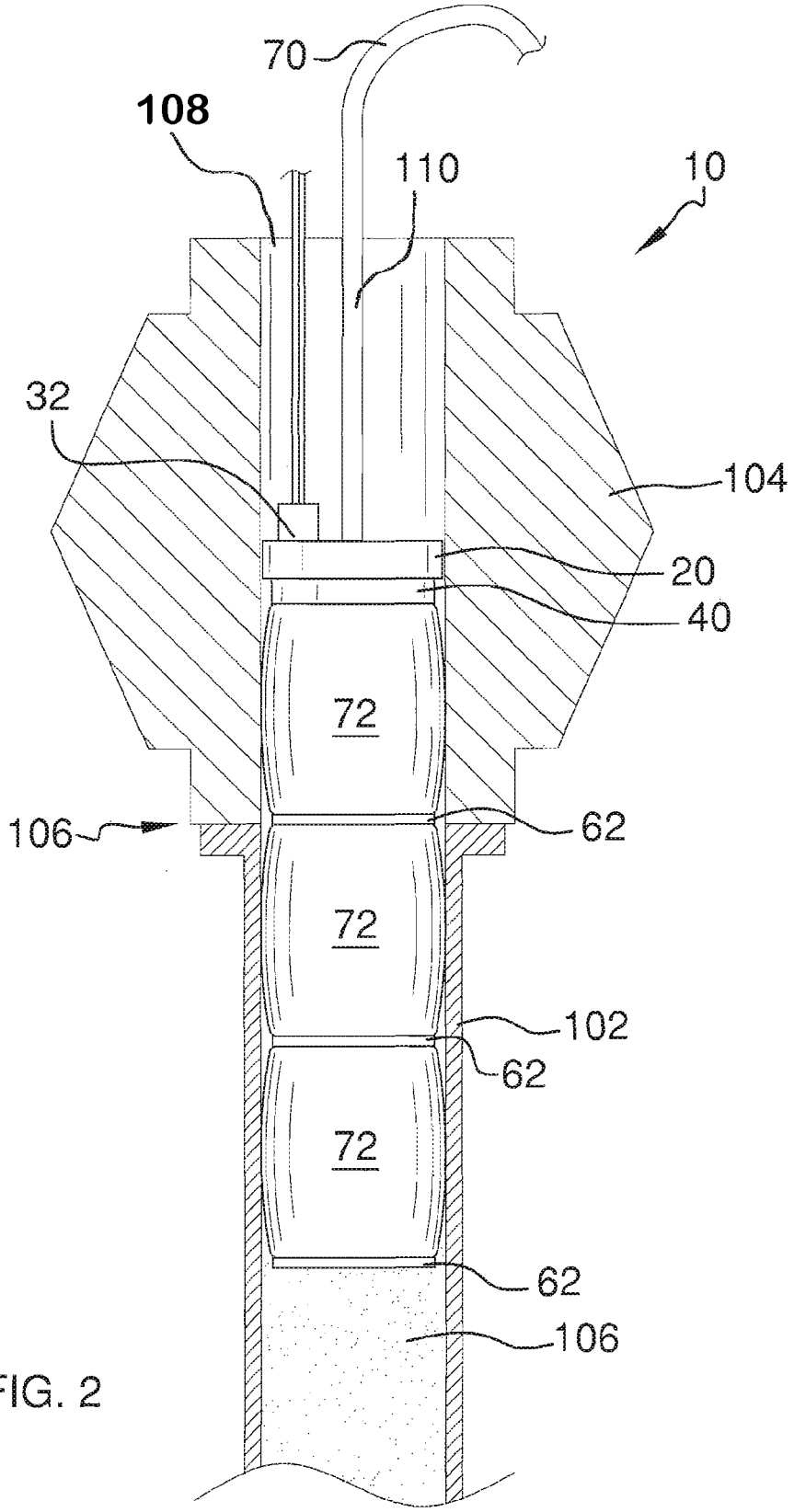
FIG. 2 is a side view of the apparatus inserted through a well head into a drill hole.
Figure 3:
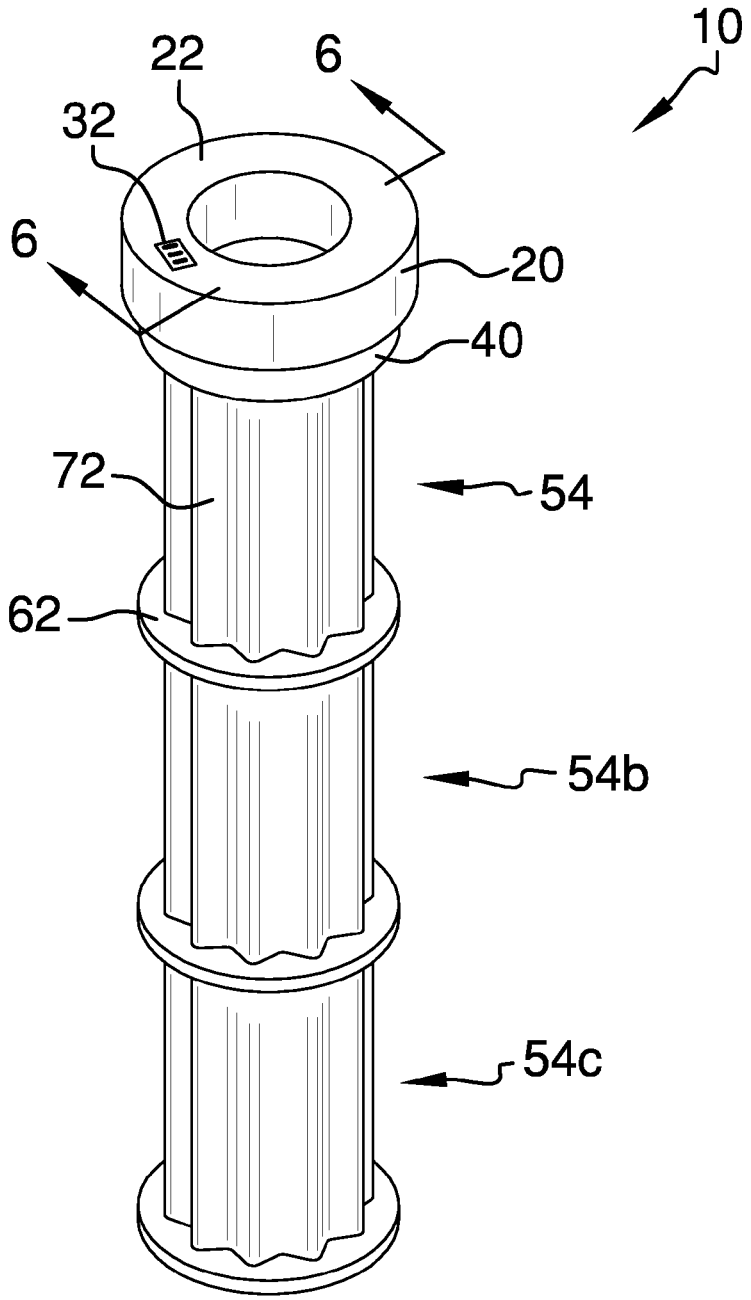
FIG. 3 is an isometric view of the device.
Figure 4:
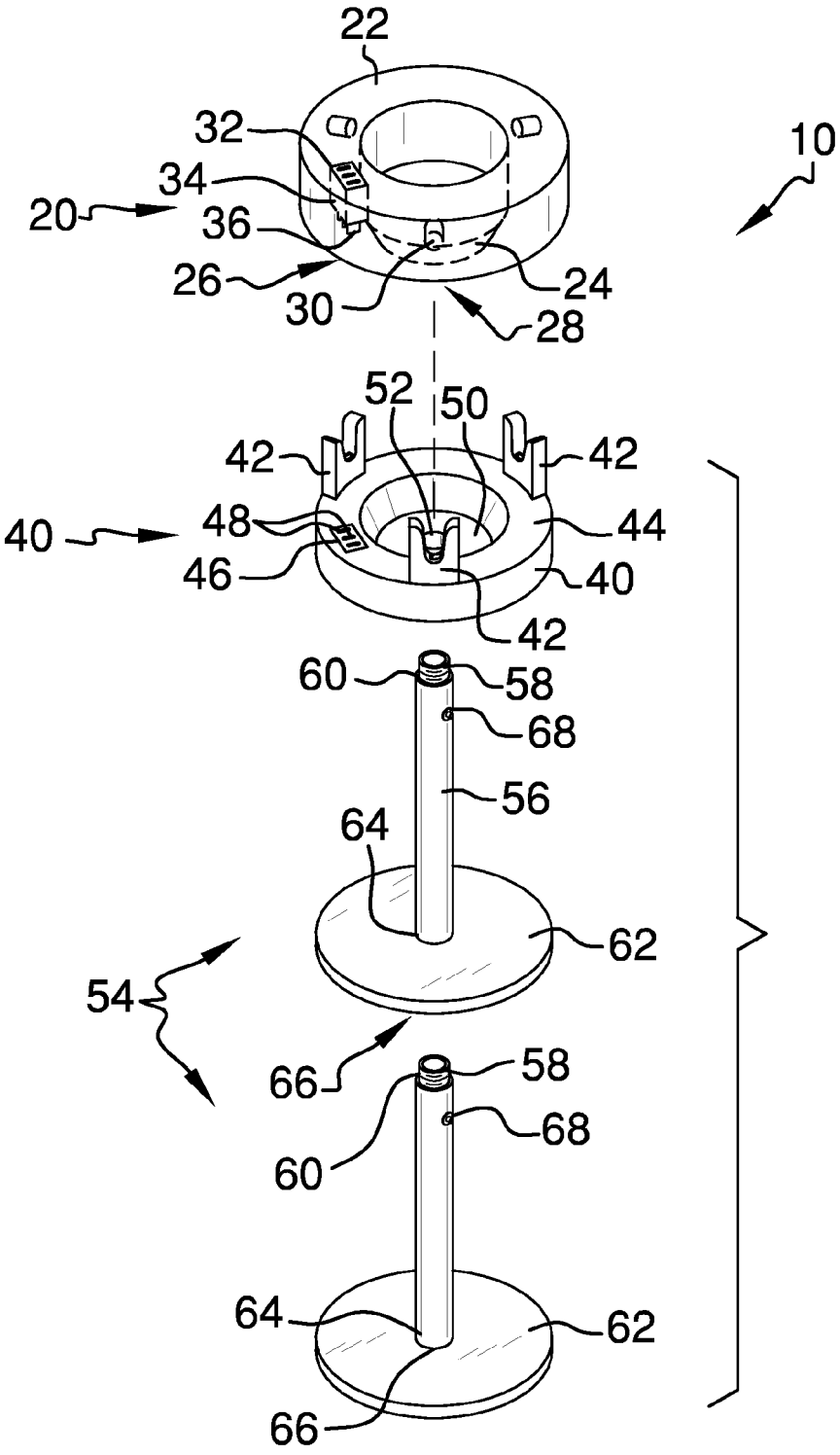
FIG. 4 is an exploded view of a drill string mating unit, a top ring, and a pair of interconnectable support members.
Figure 5:
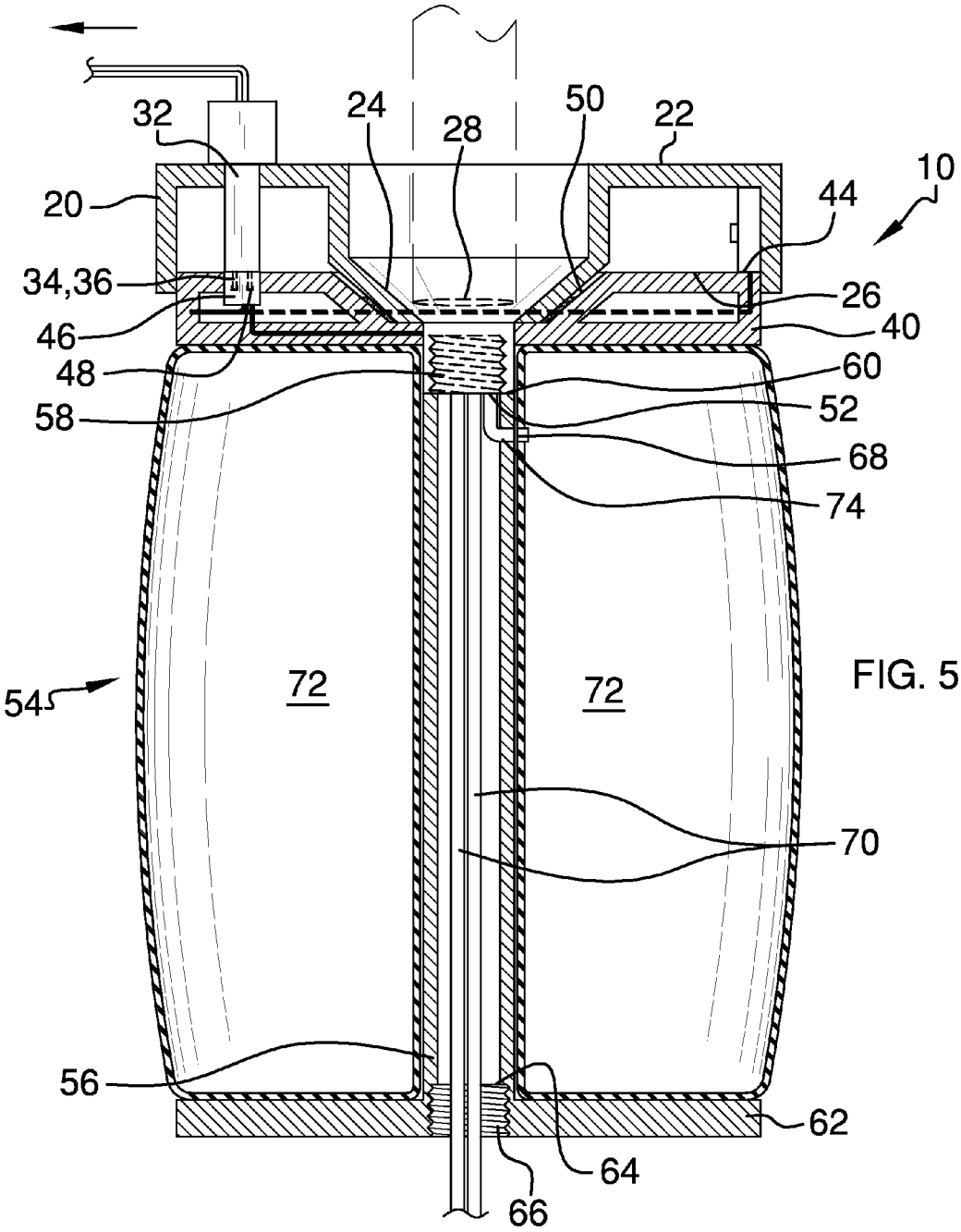
FIG. 5 is a longitudinal section view of the drill string mating unit, the top ring, and one support member.

With reference now to the drawings, and in particular FIGS. 1 through 4 thereof, example of the instant emergency well plug apparatus employing the principles and concepts of the present emergency well plug apparatus and generally designated by the reference number 10 will be described.

Referring to FIGS. 1 through 4 a preferred embodiment of the present emergency well plug apparatus 10 is illustrated.

The present emergency well plug apparatus 10 has been devised to seal off a wellhead 100 after retracting a drill, for maintenance, or in an emergent situation following a blowout. The present device 10 is contemplated to insert into a wellhead 100 and inflate at least one inflatable member 72 to seal off the casing 102, blowout preventer 104, bore hole 106, or well shaft 108, and thereby maintain fluids within the substrate to prevent contamination of the surrounding environment.

The emergency well plug apparatus 10 is contemplated to attach endwise to a drill collar (not shown) in lieu of a drill bit, or other part of a suitable drill string, by means of an annular drill string mating unit 20. The annular drill string mating unit 20 includes an annular surface 22 disposed to connect endwise to the drill collar (not shown) or drill string 110. An infundibular beveled intake 24 is disposed upon the annular drill string mating unit 20 and projected downward to interconnect with a beveled fitting 50 disposed upon a top ring 40, as will be described subsequently.

An annular undersurface 26 is disposed underlying the annular surface 22 surrounding the beveled intake 24. The annular undersurface 26 is disposed to overlie a top surface 44 of the top ring 40 when the drill string mating unit 20 and top ring 40 are coupled. A first aperture 28 is centrally disposed in the beveled intake 24 to accommodate the passage of internal components, as will be described subsequently, into at least one support member 54 attached to the top ring 40.

To releasably secure the drill string mating unit 20 to the top ring 40, and thence to the apparatus as a whole, a plurality of locking studs 30 is disposed upon the annular undersurface 26. Each of the plurality of locking studs 30 is moveable between a first position and a second position to alternately secure the drill string mating unit 20 to the apparatus 10 as a whole and release the top ring 40 and the apparatus there attached once positioned within a wellhead 100.

An electronic data port 32 is disposed upon the annular surface 22, said electronic data port 32 in operational communication with a remotely disposed control panel (not shown) whereby readings of pressure may be determined and the plurality of locking studs 30 (and additional features of the apparatus) controlled. Connection means 34 is disposed extending underneath the annular undersurface 26 from the electronic data port 32 to interconnect the electronic data port 32 in circuit with sensors disposed therebelow. The connection means 34 are contemplated as a plurality of prong members 36 releasably insertable into a data port connector 46 disposed upon the top ring 40, as will be described subsequently.

The top ring 40 releasably couples to the annular drill string mating unit 20. The top ring 40 includes a plurality of vertically disposed latch members 42 upon the top surface 44, each of said latch members 42 disposed to interconnect with each of the locking studs 30 when the top ring 40 and annular drill string mating unit 20 are coupled and the locking studs 30 are moved to the first position. Thus, when the emergency drill plug apparatus 10 is positioned within a well, each of the plurality of locking studs 30 is moveable to the second position to release the top ring 40, thereby enabling retraction of the drill string 110 with the remainder of the plug apparatus released and left in position in a well shaft 108.

Figure 6:
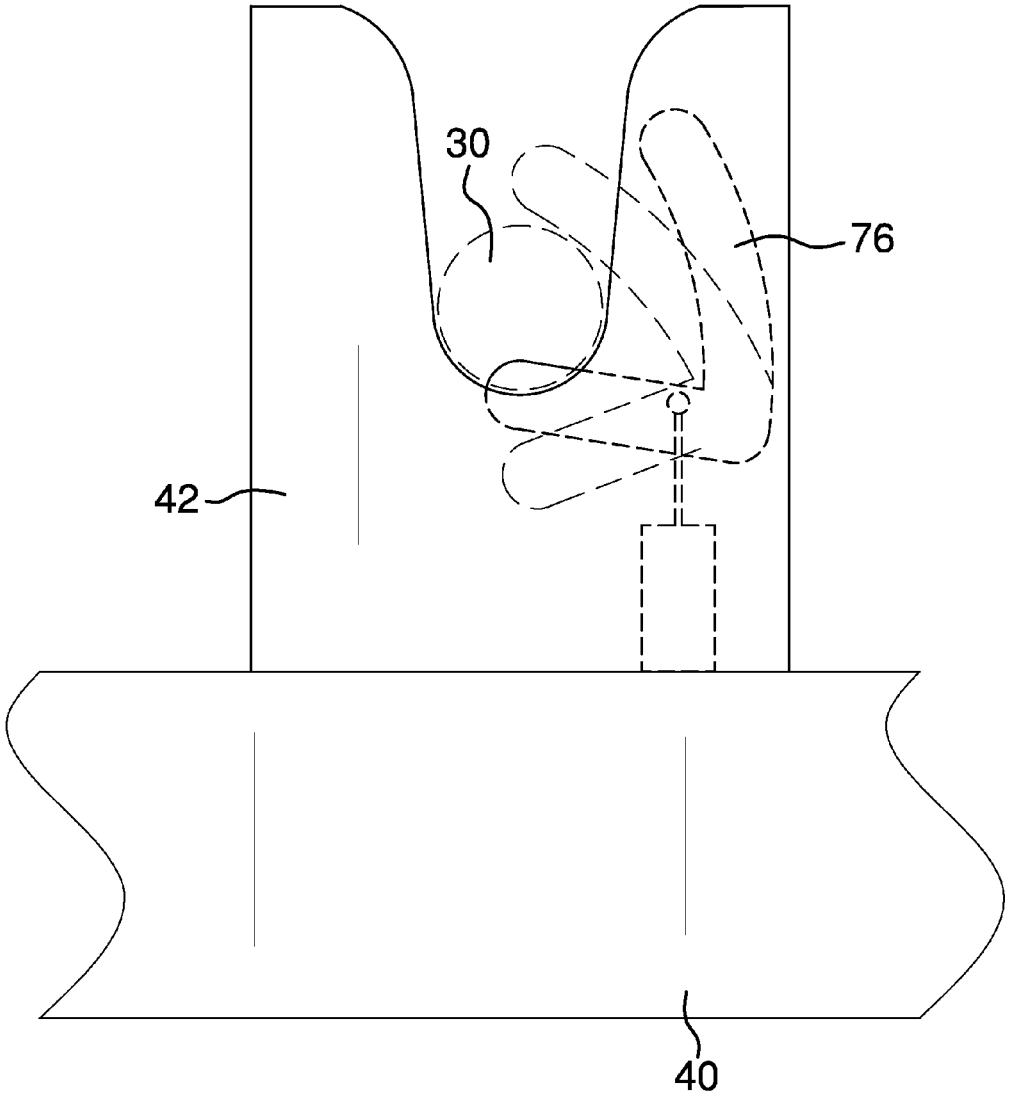
FIG. 6 is a cross section view taken along the line 6-6 of FIG. 3.
Figure 7:
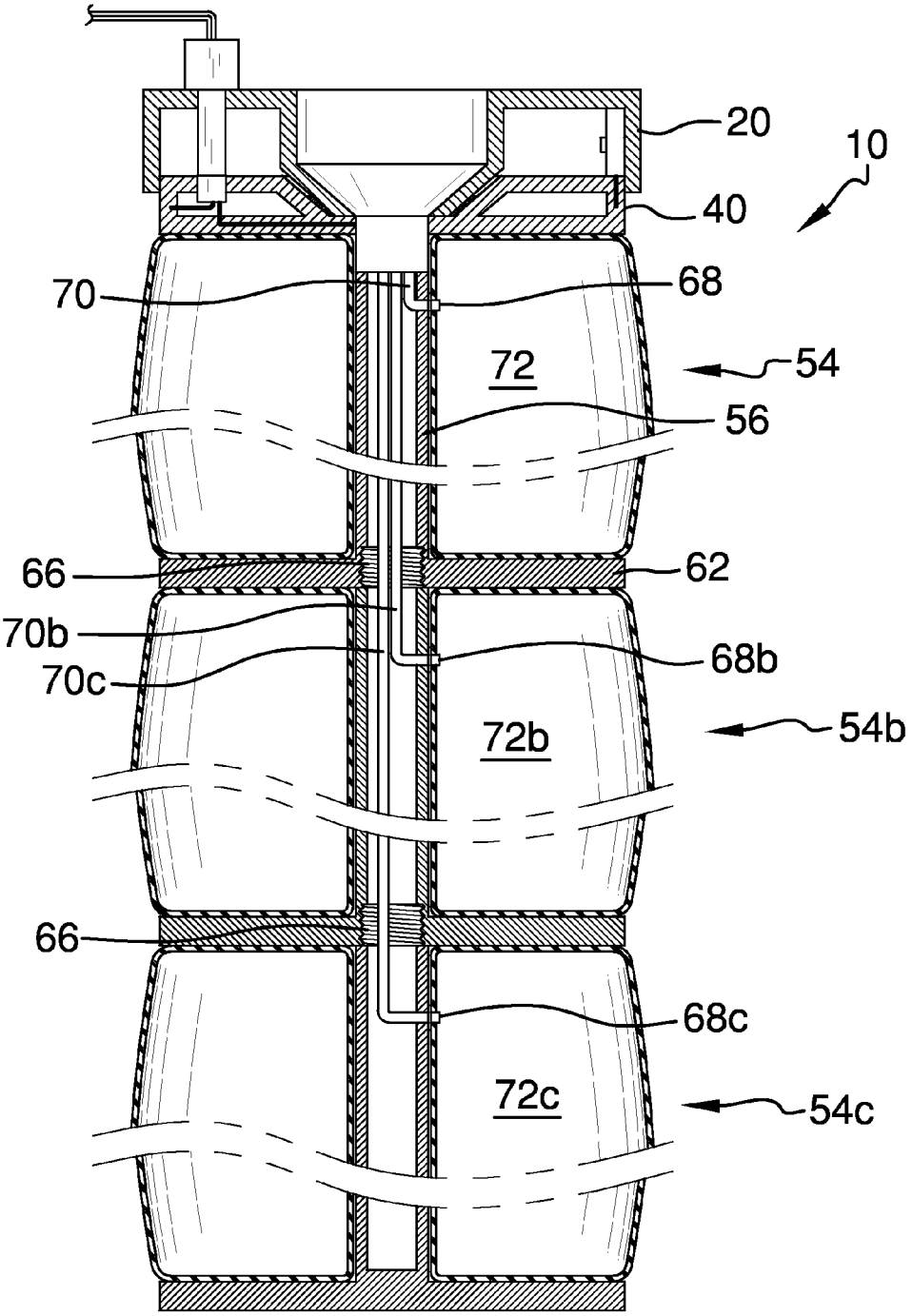
FIG. 7 is a longitudinal section of the apparatus.

An alternate attachment mechanism between the drill string mating unit 20 and the top ring 40 is contemplated and illustrated in FIG. 6. In FIG. 6 each of a plurality of latch gates 76 is illustrated, each of which engages with each locking stud 30. In this embodiment the locking studs 30 do not move, instead the latch gate 76 is moveable from a first position to a second position to releasably couple the drill string mating unit 20 to the top ring 40. Additional attachment mechanisms are further contemplated, such as a rotational engagement between the drill string mating unit 20 and the top ring 40.

The data port connector 46 is disposed upon top ring 40 and positioned to interconnect with the electronic data port connection means 34 when the top ring 40 and annular drill string mating unit 20 are coupled. Thus the prong members 36 of the electronic data port 32 releasably insert into each of a plurality of slot members 48 disposed upon the data port connector 46 to maintain a circuit, and thus operational communication, throughout the apparatus 10.

The infundibular beveled fitting 50 is disposed to mesh upon the beveled intake 24 when the top ring 40 and the annular drill string mating unit 20 are coupled. A second aperture 52 is disposed in the beveled fitting 50 to superimpose over the first aperture 28 thereby accommodating passage of internal components into at least one support member 54, as will now be described.

A support member 54 is releasably attachable to the beveled fitting 50. Additional support members 50*b* may be attached to this support member 50, as will be described subsequently, whereby a series of support members may be longitudinally disposed vertically underlying the top ring 40 in a linear disposition suited for insertion into a wellhead 100. At least one support member 54 is required to operate the apparatus 10, to attach directly to the second aperture 52 in the beveled fitting 50, but each support member 54 is identical and may be additionally attached to a preceding support member attached to the second aperture 52 in the manner to be described.

Each of the at least one support member 54 includes a central pipe member 56 having an inset threaded first end 58. The inset threaded first end 58 has an outer diameter less than the outer diameter of the central pipe member 56 and is configured to threadably insert into the second aperture 52 in the beveled fitting 50, whereby the pipe member 56 is releasably attached to the top ring 40 and perpendicularly disposed there beneath. A ring surface 60 is disposed circumferentially surrounding the inset threaded first end 58 where the inset threaded first end 58 and the central pipe member 56 join, said ring surface 60 configured to sealingly engage against the beveled fitting 50 circumferentially around the second aperture 52 when the inset threaded first end 58 is inserted into the second aperture 52.

A disk member 62 is disposed perpendicularly upon a second end 64 of the pipe member 56. The disk member 62 has a diameter comparable to the outer diameter of the top ring 40. A threaded aperture 66 within the second end 64 is disposed to releasably receive the inset threaded first end 58*b* of a subsequently attached support member 54*b*, in the manner best illustrated in FIG. 4. The ring surface 60*b* of this subsequently attached support member 50*b* sealingly engages against the second end 64 of the support member 54 in like manner as described above.

Thus, a first support member 54 is attachable to the top ring 40, a second support member 54*b* is attachable to the first support member 54, and a third support member 54*c* attachable to the second 54*b*, and so on, whereby a desired quantity of support members is assembled into a single emergency drill plug apparatus 10, and a desired length may be assembled to correspond to a desired depth of penetration into a particular well. More support members thus assembled enable a greater distribution of pressure along a section of a well shaft when each inflatable member 72 is activated, as will be subsequently described, to resist the pressures of fluid coursing up from the depths.

An air outlet 68 is disposed upon the surface of each of the at least one pipe member 56 proximal the first end 58. An air conduit 70 is disposed through the first and second apertures 28, 52, into the at least one support member 54 to vent at the air outlet 68. Air may be forcibly expended through the air conduit 70 and vented out the air outlet 68 to rapidly inflate an inflatable member 72 disposed circumferentially around the central pipe member 56 upon the disk member 62. The inflatable member 72 is disposed surrounding the entire pipe member 56, from the disk member 62 up to the ring surface 60. The inflatable member 72 is configured to inflate around the length of the pipe member 56 to occupy a radial diameter larger than the diameter of the disk member 62 to thereby engage against the blowout preventer 104, casing 102, or well shaft 108 of a particular well into which the apparatus 10 is inserted.

At least one pressure sensor 74 is disposed in operational communication with the data port connector 46, said pressure sensor 74 sensibly disposed in the air conduit 70 to enable internal pressure readings to signal when the inflatable member 72 has been suitably inflated.

Air conduits 70*b*, 70*c* are routed to air outlets 68*b*, 68*c* disposed on additional support members 54*b*, 54*c* attached to the apparatus 10. The apparatus 10 is configured to inflate the inflatable member 72*c* disposed on the lowermost support member 54*c* first, and then, in rapid succession, inflate each support member in a sequence from the lowermost support member 54*c* to the uppermost support member 54. Pressure at each support member, from fluid ejecting from the well in question, is thus reduced relative each inflation episode—the preceding inflation episode obstructing some of the fluid—and the particular well to which the apparatus 10 is inserted is effectively plugged by this sequence.

The inflatable member 72 of each support member 54 is contemplated to be made of a para-aramid material—lightweight and strong. Each support member 54 is contemplated to be made or a durable metal, such as titanium, steel, or aluminum. Each air conduit 70 is contemplated to be a braided hose drawn to each relevant air outlet 68 to force air therethrough.

Thus the emergency well plug apparatus 10 may be lowered into a relevant blowout preventer 104, wellhead 100, or well shaft 108, as case may be, and inflated therein to effectively plug said well. After inflation, the drill string 110 may be retracted after the top ring 40 has been decoupled from the drill string mating unit 20 when each of the plurality of locking studs 30 is moved to the second position to release each of the plurality of latch members 42.

To remove the emergency well plug apparatus 10 once operations at the well are resumed, the drill string 110 is lowered to the wellhead 100, the drill string mating unit 20 positioned atop the top ring 40 and the plurality of locking studs 30 are moved to the first position. The drill sting mating unit 20 and the top ring 40 are now coupled, the electronic data port 32 is interconnected in circuit with the data port connector 46, and operative control of the emergency well plug apparatus 10 is restored. Each inflatable member 72 may thusly be deflated, and the apparatus 10 as a whole then retracted from the particular wellhead 100 into which it was inserted.

What is claimed is:

1. An emergency well plug apparatus comprising:

a drill string mating unit attachable endwise to an extant drill string;

a coupling top ring releasably attachable to the drill string mating unit;

a plurality of support members attachable together in series to the top ring, each support member including:

a central pipe member having a first end, a second end, and a disk member perpendicularly disposed at the second end;

an inflatable member disposed surrounding the pipe member, said inflatable member inflating to occupy a diameter greater than the diameter of the disk member; and a threaded aperture disposed at the second end to which a subsequent support member is attachable;

wherein each inflatable member is sequentially inflatable, from a lowermost inflation episode to a topmost inflation episode, whereby a gushing wellhead is pluggable and the drill string retractable therefrom;

wherein the drill string mating unit comprises:

an annular surface;

an infundibular beveled intake;

an annular undersurface disposed underlying the annular surface surrounding the beveled intake;

a first aperture centrally disposed in the beveled intake;

a plurality of locking studs disposed upon the annular undersurface moveable between a first position and a second position;

an electronic data port disposed upon the annular surface; and connection means disposed to interconnect the electronic data port with circuitry disposed in the top ring when coupled.

2. The emergency well plug apparatus of claim 1 wherein the top ring comprises:

a top surface;

a plurality of latch members disposed upon the top surface, each of said latch members disposed to interconnect with each of the locking studs when the top ring and the drill string mating unit are coupled and the locking studs are moved to the first position;

a data port connector disposed upon the top surface, said data port connector positioned to interconnect with the electronic data port connection means when the top ring and annular drill string mating unit are coupled;

an infundibular beveled fitting disposed to mesh with the beveled intake when the top ring and the annular drill string mating unit are coupled; and a second aperture disposed in the beveled fitting disposed to superimpose upon the first aperture.

3. The emergency well plug apparatus of claim 2 wherein the first end of each support member further comprises:

an inset threaded first end releasably attachable to the second aperture; and an air outlet disposed upon the surface of the pipe.

4. The emergency well plug apparatus of claim 3 further comprising an air conduit disposed interiorly within each support member, said air conduit disposed to vent at the air outlet, wherein air is forcibly expellable through each air outlet to sequentially inflate the respective inflatable member thereby.

5. An emergency well plug apparatus comprising:

an annular drill string mating unit comprising:

an annular surface disposed to connect endwise to a drill string;

an infundibular beveled intake;

an annular undersurface disposed underlying the annular surface, wherein the annular surface surrounds the beveled intake;

a first aperture centrally disposed in the beveled intake;

a plurality of locking studs disposed upon the annular undersurface moveable between a first position and a second position;

an electronic data port disposed upon the annular surface;

connection means extending underneath the annular surface from the electronic data port;

a coupling top ring releasably attachable to the annular drill string mating unit, said top ring comprising:

a top surface;

a plurality of latch members disposed upon the top surface, each of said latch members disposed to interconnect with each of the locking studs when the top ring and annular drill string mating unit are coupled and the locking studs are moved to the first position;

a data port connector disposed to interconnect with the electronic data port connection means when the top ring and annular drill string mating unit are coupled;

an infundibular beveled fitting disposed to mesh with the beveled intake when the top ring and the annular drill string mating unit are coupled;

a second aperture disposed in the beveled fitting to superimpose upon the first aperture;

at least one support member comprising:

a central pipe member having an inset threaded first end releasably attachable to the second aperture, and a second end;

a disk member disposed perpendicularly upon the second end;

an air outlet disposed upon the surface of the pipe member;

an inflatable member disposed circumferentially around the central pipe member; and an air conduit disposed through the first and second apertures and into the central pipe member, said air conduit connected to vent at the air outlet disposed upon the surface of the pipe member;

wherein the diameter of the disk member is lesser than the diameter of an extant well head, said emergency well plug apparatus insertable into a bore hole thereby, wherein air is forcibly ejected through the air outlet and the inflatable member is inflated radially about the pipe member to occupy a diameter greater than the disk member, whereby said well head is effectively pluggable and the drill string retractable when the top ring is decoupled from the drill sting mating unit.

6. The emergency well plug apparatus of claim 5 wherein a plurality of support members are interconnectable, each inset threaded upper end threadably connectable to a threaded hole centrally disposed in the disk member of a preceding support member, whereby a plurality of air conduits is disposed to vent air forcibly out of each respective air outlet whereby each inflatable member is inflatable around each support member.

7. The emergency well plug apparatus of claim 6 wherein the data port connector is in operational communication with a pressure sensor disposed within each air conduit whereby air is shut off when each inflatable member reaches a specific pressure.

8. The emergency well plug apparatus of claim 7 wherein the data port connector controls air flow into each inflatable member, starting with a lowermost inflatable member disposed on a lowermost support member, and then routes air sequentially through each inflatable member upwards towards the top ring, wherein each inflatable member is inflated sequentially from a lowermost inflation episode to a topmost inflation episode.

9. The emergency well plug apparatus of claim 8 wherein each inflatable member is deflatable when the drill string mating unit and top ring are re-coupled, whereby the apparatus is retractable from a wellhead when desired.

10. An emergency well plug apparatus comprising:

an annular drill string mating unit comprising:

an annular surface disposed to connect endwise to a drill string;

an infundibular beveled intake;

an annular undersurface disposed underlying the annular surface surrounding the beveled intake;

a first aperture centrally disposed in the beveled intake;

a plurality of locking studs disposed upon the annular undersurface, each of said locking studs moveable between a first position and a second position;

an electronic data port disposed upon the annular surface, said electronic data port in operational communication with a remotely disposed control panel;

connection means extending underneath the annular surface from the electronic data port;

a coupling top ring releasably attachable to the annular drill string mating unit, said top ring comprising:

a top surface;

a plurality of latch members disposed upon the top surface, each of said latch members positioned to interconnect with each of the locking studs when the top ring and annular drill string mating unit are coupled and the locking studs are moved to the first position;

a data port connector disposed to interconnect with the electronic data port connection means when the top ring and annular drill string mating unit are coupled;

an infundibular beveled fitting disposed to mesh with the beveled intake when the top ring and the annular drill string mating unit are coupled;

a second aperture disposed in the beveled fitting disposed to superimpose upon the first aperture;

at least one support member comprising:

a central pipe member having an inset threaded first end and a second end, said inset threaded first end releasably attachable to the second aperture;

a disk member disposed perpendicularly upon the second end of the pipe;

a threaded aperture within the second end disposed to releasably receive the inset threaded first end of a subsequently attached support member;

an air outlet disposed upon the surface of the pipe;

an inflatable member disposed circumferentially around the central pipe upon the disk member, said inflatable member configured to inflate around a length of the pipe member to occupy a diameter larger than the diameter of the disk member;

at least one air conduit disposed through the first and second apertures and into each of the at least one support member central pipe, said air conduit connected to the air outlet disposed upon the surface of the pipe member; and at least one pressure sensor disposed in operational communication with the data port connector, said pressure sensor sensibly disposed in each air conduit;

wherein the diameter of the disk member is lesser than the diameter of an extant well head, said emergency well plug apparatus insertable into a drill hole thereby, wherein air is forcibly ejected through each air outlet sequentially from the lowermost air outlet to the uppermost air outlet as controlled by the pressure sensed through the data port, whereby each inflatable member is inflated radially about the pipe to occupy a diameter greater than the disk member, whereby said well head is effectively plugged and the drill string retractable when each of the plurality of locking studs is moved to the second position, and the drill string mating unit and top ring are decoupled thereby.

* * * * *